US005998108A

United States Patent [19]

Martin

[11] Patent Number: 5,998,108

[45] Date of Patent: Dec. 7, 1999

[54] PROCESS FOR THE TREATMENT OF SEASONED STABILIZATION BATHS USED IN PHOTOGRAPHIC PROCESSING

[75] Inventor: Didier J. Martin, Givry, France

[73] Assignee: Eastman Kodak Company, Rochester, N.Y.

[21] Appl. No.: 09/234,762

[22] Filed: Jan. 21, 1999

[30] Foreign Application Priority Data

Jan. 21, 1998 [FR] France ..... 98 00816

[51] Int. Cl.[6] ..... G03C 7/44

[52] U.S. Cl. ..... 430/398; 430/372; 430/428

[58] Field of Search ..... 430/398, 372, 430/428

[56] References Cited

U.S. PATENT DOCUMENTS 5,679,503 10/1997 Martin et al. ..... 430/400

FOREIGN PATENT DOCUMENTS 0 407 979 1/1991 European Pat. Off. .
0 435 352 7/1991 European Pat. Off. .
2 737 792 2/1997 France .

*Primary Examiner*—Hoa Van Le

[57] ABSTRACT

This invention relates to a process for the treatment of a seasoned stabilization bath containing at least 2 g/l of thiosulfate carried over from the fixing or bleach-fixing bath wherein said stabilization bath is treated by means of a nanofiltration system to yield a photographically useful permeate. The process in this invention allows the volume of photographic effluents to be significantly reduced.

9 Claims, 1 Drawing Sheet

Figure 1:
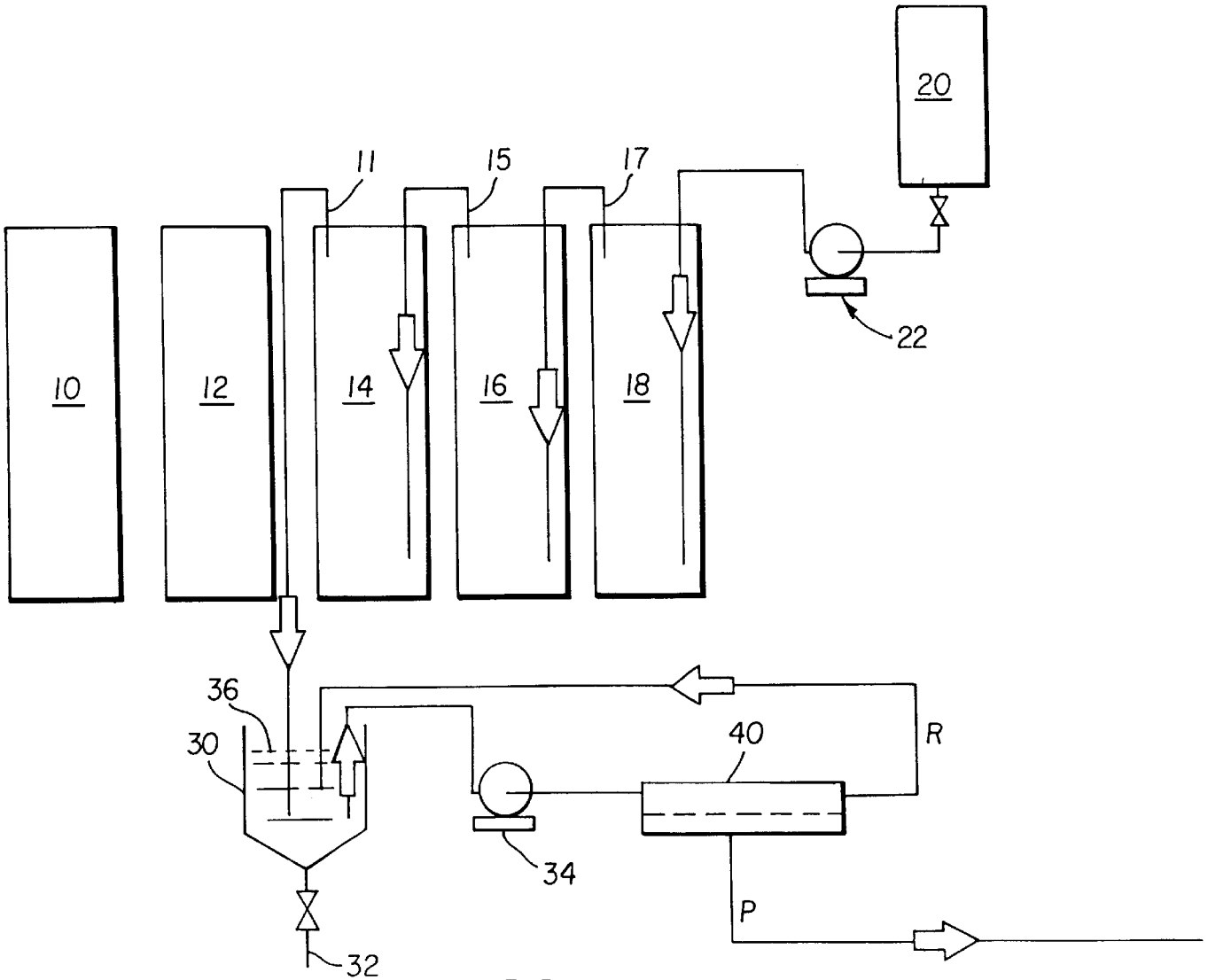

PROCESS FOR THE TREATMENT OF SEASONED STABILIZATION BATHS USED IN PHOTOGRAPHIC PROCESSING

This invention relates to a process for treating a seasoned stabilization bath containing a pollutant carried over from the fixing or bleach-fixing bath.

Numerous manufacturing and processing methods generate effluents that cannot be disposed of via the sewers because of their composition, and that contain substances the recovery and re-use of which could be economically gainful. One example is the photographic industry, in which exposed films and photographic papers are treated in successive processing baths rich in chemicals. Such methods for processing photographic materials are well known (see for example, Chimie et Physique Photographiques, Pierre Glafkides, Vol. 2, ch. XL, pages 947–967).

The processing of color photographic materials conventionally comprises a color development step, and a desilvering step. This desilvering step comprises bleaching of the photographic material, which consists in converting the free silver into silver ions, followed by fixing, which consists in removing the silver ions contained in the photographic material. Conventionally, the photographic processing can include washing and stabilizing baths.

For the processing of color papers or films, it is accepted practice to use a stabilization bath as a final bath. Such a bath allows the dye stain to be reduced and/or the stability of the dyes to be improved. Conventionally, the stabilization bath contains a dye stabilizer such as formaldehyde or a precursor of formaldehyde, hardeners, alkanolamine compounds, etc. Stabilization baths are described in *Research Disclosure*, September 1996, N°38957, section XX, D.

Photographic materials are usually developed automatically and as rapidly as possible. During processing, the photographic material is conveyed through each of the baths described above. As the photographic material travels from tank to tank, appreciable quantities of chemicals are carried over from one tank to the next one, either on the photographic material itself, or on the belts that convey the photographic material. These chemicals build up in the processing baths, thereby reducing the efficiency of these baths. The pollution of baths by carry-over of chemicals worsens as the processing speed of photographic materials increases. To avoid such pollution problems, washing baths are placed between successive processing baths. In particular, after treatment in a fixing or bleach-fixing bath, the film is conveyed through several washing baths before being immersed in the stabilization bath.

One way to overcome the loss of efficiency of baths by carry-over of chemicals is to use a replenishing solution. In practice, a replenishing solution is introduced into the polluted bath to be replenished, and an equivalent volume of spent bath runs off via the overflow.

This method generates an appreciable volume of spent bath solutions that are no longer of any use in photographic processing.

U.S. Pat. No. 5,552,055 describes a method for treating photographic effluents from 'minilabs'(small rapid automatic photographic processing units). In this method, a mixture of effluents from the minilab are first treated with adsorbents to eliminate organic and inorganic compounds, and the fluid obtained is then filtered through a membrane. U.S. Pat. No. 5,552,055 specifies that the fluid thus treated can be either disposed of via the sewers, or re-used in the photographic processing. Although this method reduces the volume of toxic solid effluents obtained in the adsorption step, it does not fully solve the problem of effluent disposal, because the solid effluents have still to be made safe.

To reduce the volume of photographic effluents and the quantity of chemicals needed for the development of photographic materials, it is desirable to replenish the seasoned baths to recycle them in the photographic processing method, thereby reducing the useful volume of replenishing solutions, and therefore the volume of the photographic processing effluent.

It is known to treat the washing baths in photographic processing by various means of filtration, such as reverse osmosis, ultrafiltration, or nanofiltration. These washing baths can be easily treated by these techniques because they contain low concentrations of chemicals. Patent Applications EP 409,065, 407,979 and 435,352 describe methods for the processing of a photographic material in which the replenishing of the washing solutions and/or stabilization bath is performed by reverse osmosis. However, this process is applied only to solutions that contain low concentrations of pollutants from the fixing or bleach-fixing bath, by means of an intermediate bath. This intermediate bath, which is more concentrated, is not submitted to reverse osmosis. Spent washing solutions generally contain a quantity of pollutants of the order of 1 g/l, much lower than the quantity of pollutants present in the other spent photographic processing baths. In particular, spent stabilization baths contain a total quantity of pollutants generally greater than 10 g/l. These pollutants include, for example, thiosulfates, sulfate, a silver complex, a ferric complex, etc. Such concentrations of pollutants preclude efficient treatment of stabilization baths by reverse osmosis.

A way to reduce the time taken to process photographic materials is to reduce the number of washing baths. In particular, processing time is reduced when the photographic material, after the fixing or bleach-fixing bath, go straight to a stabilization bath with no intermediate washing.

Chemicals specific to the fixing or bleach-fixing bath are then carried over into the stabilization bath. The stabilization bath is thus polluted by thiosulfates, complexed silver, iron, polythionates, etc. These compounds degrade the stabilization bath when they are present by the formation of precipitates, sulfur, etc. A photographic material processed in such a polluted stabilization bath will display unacceptable sensitometric characteristics.

Given the problems arising from the use of rapid photographic processing, it is desirable to provide systems that can treat and recycle as fully as possible the spent stabilization bath.

It is an object of this invention to provide a process for treating such a spent stabilization bath so as to reduce the volume of photographic processing effluent.

It is another object of this invention to treat said stabilization bath in order to make it photographically reusable.

It is another object of this invention to provide a process for such treatment that allows the volume of replenishing solution to be reduced, together with the quantity of chemicals and the volume of water needed for the processing of photographic materials.

These and other objects are achieved in accordance with this invention, which provides a process for the treatment of a photographic stabilization bath containing at least 2 g/l of thiosulfate, comprising treating the stabilization bath with a nanofiltration system to yield a photographically useful permeate.

This invention also relates to a method of photographic processing comprising the treatment of a photographic material in a fixing or bleach-fixing bath, followed by a stabilization bath, the method comprising treating the stabilization bath when it contains at least 2 g/l of thiosulfate by means of a nanofiltration system to yield a photographically useful permeate.

The photographic processing method of the invention is particularly suitable for those processes in which the stabilization bath comes straight after the fixing or bleach-fixing bath, with no intermediate washing bath.

The process of the invention provides a photographically useful permeate, i.e., a solution that can be re-used in one of the photographic processing baths either directly, or in the preparation of one of these baths, while maintaining the sensitometric characteristics of the photographic materials processed in these baths within the tolerance limits for the photographic process. In particular, the permeate has to be colorless and the nanofiltration membrane has to have a wetting angle less than or equal to 30°, preferably less than 20°. The concentration of thiosulfate in the permeate has to be no more than 2 g/l.

The process of this invention allows the volume of photographic processing effluents to be significantly reduced, because it yields a permeate that can be directly re-used in a photographic processing bath.

For example, the permeate can be used to compensate for evaporation from the bleaching, fixing, bleach-fixing and stabilization baths, or to prepare a replenishing solution for these baths from concentrated solutions.

The process of the invention allows treatment of the stabilization bath in a single easily performed and efficient step.

Besides thiosulfates, other pollutants can be carried over into the stabilization bath by photographic materials. The other pollutants that can degrade the stabilization bath are silver complexes such as silver dithiosulfate, ferric complexes of aminopolycarboxylic acid such as complexes of iron and ethylenediaminetetraacetic acid (EDTA), complexes of iron and propylenediaminetetraacetic acid (PDTA), and polythionates. The sulfate present in the stabilization baths can leave marks on drying. The process of the invention, besides its selectivity towards thiosulfates, exhibits a high selectivity with regard to these pollutants.

In the following description, reference will be made to the drawing in which FIG. 1 is a schematic diagram of a particular embodiment of this invention.

The thiosulfate ions present in the stabilization bath are in the form of salts. These salts include ammonium thiosulfate, and alkali metal thiosulfates such as sodium thiosulfate and potassium thiosulfate.

The nanofiltration system used in the invention is a conventional system comprising one or several nanofiltration membranes able to yield a photographically useful permeate. The membranes that are useful in the invention behave in principle as large surface-area sieves, in which the 'holes' are pores of microscopic or molecular size, the dimensions of which must be very uniform so that molecules greater than a particular size are retained by the membrane while smaller molecules or simple salt ions are let through. The nanofiltration membranes that are useful in the invention have a water cutoff threshold of at least 200.

According to this invention the nanofiltration system must be able to retain pollutants contained in the stabilization bath, in particular thiosulfates, but it must not retain the organic compounds initially present in the stabilization bath when the permeate is to be re-used in the preparation of a new stabilization bath.

In a specific embodiment, the nanofiltration system must show, throughout the stabilization bath treatment, a thiosulfate retention rate of at least 0.70, preferably at least 0.8. It is also desirable to use a nanofiltration system with an iron-complex retention rate of at least 0.90 and/or a silver-complex retention rate of at least 0.9 and/or a sulfate+polythionate retention rate of at least 0.9.

In a specific embodiment, the nanofiltration system must allow retention of thiosulfates, complexed iron, complexed silver, sulfates and polythionates in the conditions described above.

To maintain such retention rates, the treatment throughput and the pressure applied will be chosen appropriately according to the nanofiltration system.

In an embodiment, the nanofiltration system comprises several filters in series. The advantage of using nanofiltration filters in series is that the flow rates and efficiencies of the system can be considerably improved.

In a specific embodiment, the nanofiltration membrane is the FILMTEC® NF45 membrane commercially available from DOW Europe Separation Systems®.

FIG. 1 is a schematic diagram of a method of photographic processing that includes a device to implement the process of the invention. As shown in FIG. 1, during the photographic processing, a photographic material (not shown in the figure) is carried by a conveyer belt into the development bath 10, into the bleach-fixing bath, 12, into the stabilization bath 14, and then into two stabilization and/or washing baths 16 and 18. A replenishing solution 20 for the stabilization bath is fed into the washing bath 18 by means of the countercurrent pump 22. The overflow 17 of the bath 18 is led through piping to the bath 16. The overflow 15 of the bath 16 is led through piping to the stabilization bath 14. The overflow 11 of the stabilization bath is then led through piping to an intermediate tank 30 fitted with an outlet 32 from which it will be treated. The solution 36 held in the intermediate tank 30 is fed by means of a pump 34 into the nanofiltration system 40. At the outlet from the system 40 is recovered a permeate (P) that can be fed back into the baths 10, 12, 14, 16, or 18. It can also be used to prepare the replenishment solution 20. The retentate R from the nanofiltration system 40 is fed back into the intermediate tank 30.

Alternatively, the device comprises a single washing bath 16 and the replenishment solution is added to the washing bath 16. In another variant, the device does not include a washing bath, and the replenishment solution 20 is added directly to the stabilization bath 14.

This process is especially suitable for the treatment of stabilization baths used in minilabs. The process of this invention advantageously allows the processing of stabilizing baths from the processing of color photographic papers, such as the stabilizing bath in the C-41 FLEXICOLOR® and FLEXICOLOR SM® processes commercially available from EASTMAN KODAK, and stabilization baths from the processing of color photographic films, such as the stabilization bath in the EKTACOLOR RA4® and EKTACOLOR RA2-SM® processes commercially available from EASTMAN KODAK. It can also be used in reversal processing methods.

The process of the invention allows the treatment of mixture of stabilization baths used in the processing of photographic papers and films. By using a single process for treating stabilization baths the costs incurred by effluent treatment are reduced and the operations made simpler.

The treatment of stabilization baths in this invention can be readily integrated in a minilab because the treatment needs no technical intervention by the operator in charge of the development of the photographic materials.

The invention is described in detail in the following examples.

EXAMPLE 1

In this example, a spent stabilization bath was treated by means of a Berghof® nanofiltration cell commercially available from the Prolabo company, of capacity 400 ml fitted with a nanofiltration membrane having a surface area of 32 $cm^2$. The cell was equipped with a magnetic stirrer.

Into the cell was introduced 250 ml of one of the spent stabilization baths described below. After closing the cell, nitrogen was introduced so as to obtain a pressure enabling a permeate flow between 15 and 55 $l/m^2.h$.

In examples 1.1 to 1.3 below was treated a spent stabilization bath of the KODAK FLEXICOLOR® C41 process designed for the processing of negative photographic films. This bath was used in the treatment method illustrated in FIG. 1. The spent stabilization bath treated by nanofiltration was solution 11 of FIG. 1 at the outlet from the stabilization bath 14.

This stabilization bath contained (averages):

THIOSULFATE=2.5 g/l

SULFATE=1.5 g/l

Silver dithiosulfate complex=33 mg/l

Iron-EDTA complex=30 mg/l

In examples 1.4 to 1.6 below was treated a spent stabilization bath obtained from the stabilization bath of the KODAK EKTACOLOR® RA4 process designed for the processing of color photographic papers. This bath was used in a processing method that comprised, in succession, a developing bath, a bleach-fixing bath, and four stabilization baths. The replenishing solution is added to the last stabilization bath. The treated spent stabilization bath in these examples was the overflow from the first stabilization bath obtained as indicated in FIG. 1.

This spent stabilization bath contained (averages):

THIOSULFATE=5.4 g/l

SULFATE=2.0 g/l

Silver dithiosulfate complex=0.6 g/l

Iron-EDTA complex=1.0 g/l

The nanofiltration was performed using the following membranes: FILMTEC NF45® (cutoff threshold 200), marketed by DOW Europe Separating Systems, SelRO® MPF-11 (cutoff threshold 300) and MPF-34 (cutoff threshold 300) marketed by Kiriat Weizmann Ltd. The wetting angles were determined by the Wilhemy blade method, which is based on the measurement of the force necessary to remove from a liquid a thin plate of a sample hung from one of the arms of a balance, and dipping into this liquid. The liquid is maintained at 24° C. Beforehand, the surface tension of the liquid $\gamma$ was measured by means of a slip of filter paper for which $\theta=0$. The wetting angle is given by the following formula:

$$\cos\theta=\Delta W/Pe.\gamma$$

where $\Delta W$ is the variation in weight of the plate when it makes contact with the liquid, and Pe is the perimeter of the plate.

In the scope of this invention, a variation in the wetting angle of +/−3° indicates a change of the surface state. The hydrophobicity increases with the value of the wetting angle.

The performance of these membranes during the treatment of spent stabilization baths is set out in Tables 1, 2 and 3 below.

TABLE 1

| | Bath treated | MEMBRANE | Wetting angle | PRESSURE (bars) | Max permeate flow ($l/m^2.h$) | Permeate yield (%) | Coloration of permeate |
|---|---|---|---|---|---|---|---|
| Ex. 1.1 | C41 | NF45 | 18.5° | 35 | 51.87 | 85 | colorless |
| Ex. 1.2 | C41 | MPF-11 | 74.9° | 21 | 51.66 | 99.2 | yellow |
| Ex. 1.3 | C41 | MPF-34 | 22.6° | 30 | 15.15 | 39 | colorless |
| Ex. 1.4 | RA4 | NF45 | 18.5° | 35 | 43.75 | 84 | colorless |
| Ex. 1.5 | RA4 | MPF-11 | 74.9° | 21 | 49.58 | 95 | orange-red |
| Ex. 1.6 | RA4 | MPF-34 | 22.6° | 30 | 16.87 | 54 | yellow |

Permeate yield (%): (volume of permeate/initial volume of solution to be treated) * 100.

TABLE 2

| | Stabilization bath | MEMBRANE | Retention of different ionic species present according to type of membrane: TR ($S_2O_3$) | TR ($SO_4$) | TR (complexed Ag) | TR (complexed Fe) |
|---|---|---|---|---|---|---|
| Ex. 1.1 | C41 | NF45 | 0.99 | 1.00 | 1.00 | 1.00 |
| Ex. 1.2 | C41 | MPF-11 | —(*) | —(*) | —(*) | —(*) |
| Ex. 1.3 | C41 | MPF-34 | 0.95 | 0.97 | 0.98 | 0.96 |
| Ex. 1.4 | RA4 | NF45 | 0.92 | 0.98 | 1.0 | 1.0 |
| Ex. 1.5 | RA4 | MPF-11 | 0.65 | −0.10 | 1.0 | 0.97 |
| Ex. 1.6 | RA4 | MPF-34 | 0.98 | 0.98 | 0.99 | 0.99 |

(*): not measured

TR is the retention rate, equal to $1-(Cx_p/Cx_r)$, where $Cx_p$ is the concentration of species x in the permeate, and $Cx_r$ is the concentration of species x in the retentate. This retention rate is the retention rate after treatment of 250 ml of spent stabilization bath.

TABLE 3

| | Stabilization bath | MEMBRANE | $S_2O_3$ (ppm) | $SO_4$ (ppm) | Complexed Ag (ppm) | Complexed Fe (ppm) |
|---|---|---|---|---|---|---|
| | Composition of permeates obtained after nanofiltration from spent stabilization baths | | | | | |
| Ex. 1.1 | C41 | NF45 | 149 | 23 | 1 | 1 |
| Ex. 1.2 | C41 | MPF-11 | 1,890 | 860 | 10 | 6 |
| Ex. 1.3 | C41 | MPF-34 | 152 | 84 | 1 | 2 |
| Ex. 1.4 | RA4 | NF45 | 400 | 42 | 1 | 3 |
| Ex. 1.5 | RA4 | MPF-11 | 2,320 | 2,740 | 4 | 380 |
| Ex. 1.6 | RA4 | MPF-34 | 169 | 108 | 10 | 23 |

These results show that using membranes with a comparable cutoff threshold, the efficiency of the treatment varied widely. Although the NF45® and MPF-11® membranes both afforded high permeate yield, the NF45® membrane yielded a colorless permeate, which is a necessary condition for the permeate to be used in photographic processing. As shown in Table 3, the FILMTEC NF45® membrane offered the best performance in terms of selectivity of separation and permeate flow. The permeates obtained by treatment with the NF45® membrane were always colorless. The fall in yield with the MPF-34® membrane was due to very rapid clogging of the membrane. The MPF-11® membrane showed poor selectivity.

EXAMPLE 2

In this example, the experiment of example 1 was carried out for the treatment of a mixture of spent stabilization baths comprising one volume of KODAK FLEXICOLOR C41® stabilization bath for two volumes of KODAK EKTACOLOR RA4® stabilization bath. The spent stabilization baths were obtained under the conditions described above. A mixture of stabilization baths with the following composition was obtained. After treatment with the NF45® nanofiltration membrane carried out under the conditions described above, a permeate was obtained with the composition given in Table 4. Total organic carbon (TOC) was measured according to AFNOR standard NF T90-102, June 1985, and the chemical oxygen demand (COD) was measured according to AFNOR standard NF T90-101.

The mixture contained:

THIOSULFATE=5.06 g/l

SULFATE=2.49 g/l

Silver dithiosulfate complex=640 mg/l

Iron-EDTA complex=1.08 g/l

Initial COD=23,730 mg

Initial TOC=5,051 mg

TABLE 4

| | $S_2O_3$ | $SO_4$ | Complexed Ag | Complexed Fe | COD (mg) | TOC (mg) |
|---|---|---|---|---|---|---|
| Permeate concentration (ppm) | 300 | 130 | 4 | 3 | 9,830 | 1,491 |
| Retention rate | 0.98 | 0.98 | 1.0 | 1.0 | — | — |

These results show that the NF45 FILMTEC® membrane was efficient for the treatment of a mixture of stabilization baths.

Table 5 below summarizes the results of examples 1 and 2, showing the efficiency of the treatment using this invention.

TABLE 5

| | Spent RA4 ® process stabilization bath | Spent C41 ® process stabilization bath | Mixed spent RA4 ® + C41 ® process stabilization baths |
|---|---|---|---|
| | Overall results for efficiency of separation using the NF45 FILMTEC ® membrane. | | |
| Reduction of $S_2O_3$ | 92.7% | 93.0% | 94.1% |
| Reduction of $SO_4$ | 97.7% | 98.4% | 94.8% |
| Reduction of Ag | 99.9% | 97.2% | 99.9% |
| Reduction of Fe | 99.7% | 97.8% | 99.7% |
| Reduction of COD | 83% | 29% | 59% |
| Reduction of TOC | 99% | 41% | 70% |
| Permeate yield | 84% | 84% | 66% |

TABLE 6

Overall results for efficiency of separation using the MPF-11 ® and MPF-34 ® membranes for the treatment of a spent RA4 ® stabilization bath.

| | MPF-11 ® | MPF-34 ® |
|---|---|---|
| Reduction of $S_2O_3$ | 7.6% | 95.4% |
| Reduction of $SO_4$ | 18.5% | 96% |
| Reduction of Ag | 99.3% | 98.4% |
| Reduction of Fe | 65.5% | 97.8% |
| Permeate yield | 95% | 54% |

Reduction of pollutants was calculated using the following formula: (1−(Cx/Cxi))×100, where Cx is the concentration of species x in the permeate after treatment, and Cxi is the initial concentration of species x in the solution to be treated.

The MPF-11® and MPF-34® membranes performed less well than the FILMTEC NF45® membrane in terms of retention rate and permeate volume yield. In addition, these two membranes do not afford a colorless permeate. When such a permeate is used to prepare new stabilization solutions, such solutions are strongly colored and cause problems of dye stain and image stability of the photographic materials thus treated.

EXAMPLE 3

In this example, a spent stabilization bath was treated in a continuous operation by means of a nanofiltration system equipped with a NF45 FILMTEC® membrane with a useful surface area of 2.21 $m^2$.

A spent stabilization bath was simulated by adding a set amount of spent bleach-fixing bath to an RA2-SM process stabilization bath prepared from the commercial concentrate.

With this device, 70 liters of spent stabilization bath was treated with a permeate flow rate of 500 l/h for an average pressure of 30 bars at room temperature until a permeate yield of 66% was achieved.

The stabilization bath contained:

Thiosulfate: 14 g/l

Sulfate: 4.1 g/l

Silver dithiosulfate complex: 1.0 g/l

Iron-EDTA complex: 2.65 g/l

Initial TOC=7.9 g/l

Initial COD=33.2 g/l

TABLE 7

| Time (min) | Permeate yield | TR $S_2O_3$ | TR Ag | TR Fe |
|---|---|---|---|---|
| 0 | 0% | 0.979 | 0.990 | 0.996 |
| 15 | 29% | 0.983 | 0.992 | 0.997 |
| 30 | 47% | 0.969 | 0.990 | 0.996 |
| 60 | 66% | 0.900 | 0.974 | 0.991 |

Table 8 below gives the analysis of the concentrations of the various chemical species contained in the permeate for a permeate yield of 66%.

TABLE 8

| | $S_2O_3$ (ppm) | $SO_4$ (ppm) | Complexed Ag (ppm) | Complexed Fe (ppm) | TOC (ppm) | pH | Yield |
|---|---|---|---|---|---|---|---|
| untreated | 15,000 | 4,050 | 1,140 | 2,650 | 7,900 | 6.7 | — |
| NF45/66% yield | 1,130 | 291 | 22 | 12 | 1,244 | 6.7 | 66% |

These examples show that when the yield is 66%, the concentrations of the various contaminants in the permeate (Ag, Fe, sulfate) are very low. In particular, the concentration of thiosulfate is close to 1 g/l.

EXAMPLE 4

In this example, the permeate of Table 8 was used to prepare a new stabilization bath for the EKTACOLOR RA2-SM® process. To prepare this bath, 17 ml of stabilization bath concentrate was diluted in 3 liters of permeate.

A second stabilization bath was prepared by diluting the stabilization bath concentrate with water under the same conditions of dilution. An exposed EKTACOLOR Royal® photographic paper was then processed with the EKTACOLOR RA-2 SM process using the following processing sequence; the stabilization bath was as described above:

Development 45 s at 37.8° C.

Bleach-fixing 45 s at 37.8° C.

Rinsing (demineralized water) 20 s at 32° C.

Stabilization 100 s at 32° C.

Drying at 60° C.

The sensitometric results are given in Table 9 below.

TABLE 9

| | |
|---|---|
| Fresh sensitometry (neutral exposure) | δ Dmin = 0<br>δ speed = 0<br>δ Dmax = 0<br>δ contrast = 0 |
| Image stability/daylight aging (14 days storage, 50 KLUX) | Δ(δ Dmin) blue = +0.02<br>Δ(δ Dmin) green = 0<br>Δ(δ Dmin) red = +0.01 |
| Image stability/dark aging (14 days at 70° C.–50% R.H.) | Δ(δ Dmax) blue = +0.1<br>Δ(δ Dmax) green = 0<br>Δ(δ Dmax) red = 0 |

δx is the difference in the sensitometric characteristic x observed ween when the paper was processed with a stabilization bath prepared with water, and when the photographic paper was processed with a stabilization bath prepared from the permeate.

Δ(δx) is the difference between the δx values after 14 days of aging under the conditions stated in the above table.

The invention has been described in detail with particular reference to certain preferred embodiments thereof, but it will be understood that variations and modifications can be effected within the spirit and scope of the invention.

I claim:

1. A process for treating a photographic stabilization bath containing at least 2 g/l of thiosulfate, comprising passing said stabilization bath through a nanofiltration system to yield a photographically useful permeate.

2. The process of claim 1 wherein said permeate is recycled as a stabilization bath.

3. The process of claim 1 wherein said permeate is used to prepare a replenishing solution for said stabilization bath.

4. The process of claim 1 wherein said permeate is recycled in a washing bath.

5. The process of claim 1 wherein said nanofiltration system exhibits a thiosulfate retention rate of at least 0.7.

6. The process of claim 1 wherein said nanofiltration system exhibits a complexed iron retention rate of at least 0.9, a complexed silver retention rate of at least 0.9, and a sulfate+polythionate retention rate of at least 0.9.

7. The process of claim 1 wherein at least 50% by volume of the stabilization bath passing through the nanofiltration system is recovered in the form of photographically useful permeate.

8. The process of claim 1 wherein said stabilization bath is a stabilization bath for photographic films, or a stabilization bath for photographic papers, or a mixture of such baths.

9. A photographic processing method comprising the treatment of a photographic material in a fixing or bleach-fixing bath, then in a stabilization bath, and passing said stabilization bath when it contains at least 2 g/l of thiosulfate through a nanofiltration system to yield a photographically useful permeate.

* * * * *